US006941851B2

(12) United States Patent
Urvoy

(10) Patent No.: US 6,941,851 B2
(45) Date of Patent: Sep. 13, 2005

(54) SYSTEM FOR ELEVATION AND DIRECTIONAL ANGLE AIMING OF A WEAPON

(75) Inventor: Emile Urvoy, Roussigny (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/483,631

(22) PCT Filed: Jul. 15, 2002

(86) PCT No.: PCT/FR02/02505

§ 371 (c)(1),
(2), (4) Date: Jan. 14, 2004

(87) PCT Pub. No.: WO03/008893

PCT Pub. Date: Jan. 30, 2003

(65) Prior Publication Data

US 2004/0159229 A1 Aug. 19, 2004

(30) Foreign Application Priority Data

Jul. 17, 2001 (FR) ..... 01 09510

(51) Int. Cl.[7] ..... F41A 27/08
(52) U.S. Cl. ..... 89/37.07; 89/37.12; 89/37.13; 89/40.04
(58) Field of Search ..... 89/37.07, 37.12, 89/37.13, 40.04, 41.02

(56) References Cited

U.S. PATENT DOCUMENTS 2,339,508 A * 1/1944 Newell ..... 89/200
4,387,624 A 6/1983 Bjurström ..... 318/621
5,864,085 A * 1/1999 Begneu et al. ..... 89/37.07
2004/0200348 A1 * 10/2004 Urvoy ..... 89/37.12

FOREIGN PATENT DOCUMENTS

| | | | |
|---|---|---|---|
| DE | 3241 665 A1 | 5/1984 | |
| EP | 0 179 387 A2 | 4/1986 | |
| FR | 2 421 362 | 10/1979 | |
| GB | 633866 | * 12/1949 | ..... 89/41.09 |
| GB | 740184 | * 11/1955 | ..... 89/41.02 |

* cited by examiner

*Primary Examiner*—Stephen M. Johnson
(74) *Attorney, Agent, or Firm*—Oliff & Berridge, PLC

(57) ABSTRACT

An elevation and traverse laying system for a weapon comprising a first traverse positioning element to position the weapon in traverse along a large angular range with respect to a first axis of rotation in traverse, having a first positioning element in elevation for the weapon along a large range with respect to the first axis of rotation in elevation offset with respect to the weapon's center of gravity, a second positioning element in elevation for the weapon along a small range with respect to a second axis of rotation in elevation, and a second traverse positioning element with respect to a second axis of rotation in traverse allowing a small lateral range for the weapon, the second axis of rotation in elevation and the second axis of rotation in traverse substantially passing through the weapon's center of gravity.

23 Claims, 5 Drawing Sheets

SYSTEM FOR ELEVATION AND DIRECTIONAL ANGLE AIMING OF A WEAPON

BACKGROUND

The technical scope of the present invention is that of elevation and traverse laying systems for a weapon that ensure its stabilisation.

When a weapon is mounted onto a vehicle, it is well known to provide an elevation and traverse stabilisation system. On a mobile support, that is on a moving vehicle, laying operations become difficult to ensure, since the weapon is subjected to a certain number of disturbances. Firing from such a weapon requires it to be oriented in the direction of the target and this despite any movements, be they linear or angular, of the vehicle. One particularity of a vehicle able to move at high speeds (more than 50 km/h) cross country lies in the stresses it causes to the weapon and to its laying system and which generally correspond to a high level and cover a wide spectrum.

During displacements of the vehicle, these disturbances may notably come from:

the angular velocity of the support of which the weapon is mounted and which reach the weapon via the motorization system, the linear acceleration applied to the weapon's trunnions and which act upon its orientation by offsetting the centre of gravity, the angular acceleration applied directly to the weapon by the friction that appears on the trunnions and on the rolling of the turret.

Mounting a weapon onto a vehicle thus requires the installation of an orientation system subjected to a certain number of constraints.

The first is to allow orientation in elevation and in traverse around two axes allowing the required movements. These axes must allow the recoil stresses of the weapon to be transmitted to the support vehicle, in particular by minimising parasite torques in reaction to firing.

Geometric constraints oblige the axis of rotation in elevation to be positioned at the periphery of the turret and towards the rear of the weapon so as to optimise the free space inside the turret. In other words, the axes of rotation in elevation and in traverse are not concurrent.

The geometric organisation of the mounting of the weapon causes two constraints in particular. Firstly, the elevation range joint is generally largely offset to the rear of the weapon, with its effect upon the sensitivity of the weapon's orientation to the vertical accelerations caused when rolling. Secondly, both in elevation and in traverse, the constraints placed upon the motorization systems, but also the necessity of ensuring the sealing of the turret, give rise to frictions whose effects deteriorate the weapon's orientation accuracy.

More particularly, on certain weapon systems, the need to be able to orient the weapon in elevation to several tens of degrees (70° approximately) causes the weapon's orientation to be very sensitive to rolling of the vehicle. In fact, three types of limitations may be found that deteriorate the overall accuracy performances of the weapon. Firstly, the positioning accuracy of the weapon is adversely affected by the influence of friction because of the presence of a large diameter bearing and its associated seals. Thereafter, the offsetting of the weapon's centre of gravity in relation to the position of the joint rapidly deteriorates the quality of stabilisation provided in elevation. Lastly, the motorization torque available on the turret limits the possibility of compensating for the roll effect of the weapon's orientation thereby worsening the level stabilisation error associated with this type of disturbance, in particular if the weapon's angle of elevation increases.

Several methods and devices are known to attenuate the roll effects on the firing performances of a weapon.

A first method consists in measuring the perturbing angular velocity, for example using geometric type means, and using this measurement to control the rotational speed of the motorization system placed between the support and the weapon. It is thus an anticipatory control placed in parallel with a servo control of the weapon's position on an inertial reference whose efficiency is low so as to attenuate the amplitude of the angular disturbances at mean frequencies. Reference may be made, for example, to patent FR-80.21077.

Another method consists in providing motorization means allowing the torque applied to the load to be controlled. This principle is used to improve the efficiency of the reduction of the effects of the angular velocity disturbances. This method is adapted to low offset values. Reference may be made, for example, to patent U.S. Pat. No. 4,387,624.

In these two cases, the weapon's centre of gravity is not far from its trunnion axis.

But when the offset between the axial position of the centre of gravity and the joint axis increases, the performances obtained decrease rapidly through the combination of several mechanisms.

First of all, the offsetting of the centre of gravity increases the effect of vertical acceleration produced (unbalance effect) by rolling on the angular displacement of the weapon.

The increase in motorization torque caused by the needs in dynamic torque (despite the static balancing of the unbalance mass) leads in particular to an increase in the inertia of the motor. The sensitivity of the motorization system to noise at medium frequencies increases as a result, with as a counterpart the necessity to increase the filtering of all the sensors. The stabilisation performances are reduced by the filtering of the sensors.

On certain weapon systems, functional constraints, in particular concerning the weapon replenishment method, add geometric constraints to the offsetting of the centre of gravity, which increase the friction at the trunnions with its effect on the accuracy of the weapon's orientation.

On other systems, to minimise the space required at the rear and under the orientation axis of the weapon, the mounting of the weapon obliges the axis of orientation to be pushed back to the rear of the recoiling mass resulting in further offsetting the centre of gravity with its effect on orientation, in particular when the vehicle is moving.

When the weapon is required to be oriented in elevation away from the horizontal, the drive effect of the weapon caused by the roll of the turret rapidly contributes to the deterioration of the weapon's stabilisation and to the saturation of the turret motorization control in traverse.

SUMMARY

The aim of the present invention is to propose a laying system for a weapon that is mounted on a mobile carrier allowing the requirements of the main motorization, in elevation and in traverse, to be separated from the constraints to be imposed to control the accurate orientation of the weapon in elevation and in traverse.

The invention thus relates to an elevation and traverse laying system for a weapon comprising first means to position the weapon in traverse along a large angular range with respect to a first axis of rotation G1, wherein it comprises:

first positioning means in elevation for the weapon along a large range with respect to a first axis of rotation S1 in elevation offset with respect to the weapon's centre of gravity, second positioning means in elevation for the weapon along a small range with respect to a second axis of rotation S2 in elevation, and second lateral angular positioning means for the weapon with respect to a second axis of rotation G2 allowing a small lateral range for the weapon, axes S2 and G2 passing in the vicinity of the weapon's centre of gravity.

According to one characteristic, the first axis of rotation S1 is located to the rear of the weapon's centre of gravity.

According to another characteristic, the first positioning means ensure the articulation with respect to a frame onto which the weapon is mounted around the first axis of rotation S1.

According to another characteristic, the first positioning means comprise a mantlet supporting the weapon and integral with the frame and rotation means, the first axis S1 being positioned between the mantlet and the frame.

According to another characteristic, the rotation means ensure the rotation of the mantlet with respect to the frame.

According to another characteristic, the rotation means are formed by a jack or geared motor.

According to another characteristic, the weapon is mounted able to rotate with respect to the mantlet, the second positioning means in elevation ensuring the articulation in elevation of the weapon by rotating it with respect to the mantlet around the second axis S2.

According to another characteristic, the second positioning means comprise an intermediate ring connected to the weapon and second rotation means meshed along the second axis of rotation S2 around trunnions integral with the ring.

According to yet another characteristic, the second rotation means are formed by a motor or geared motor integral with the mantlet along the second axis of rotation in elevation S2.

The second means of rotation in elevation may comprise a jack integral with the mantlet and whose rod is connected to the weapon or to a cradle integral with the weapon, such cradle with respect to which the weapon recoils upon firing.

According to another characteristic, the second lateral angular positioning means of the weapon are integral with the cradle to ensure a low traverse range of the weapon around a second axis of rotation G2 passing through the weapon's centre of gravity.

According to another characteristic, the lateral angular range of the weapon with respect to the mantlet may be of around 2°.

According to another characteristic, the second positioning means comprise an intermediate frame or ring supporting the weapon and connected to the mantlet and means to control the lateral rotation of the weapon with respect to the mantlet.

According to another characteristic, the weapon is mounted by means of a joint with respect to the mantlet, the control means ensuring the rotation of the weapon with respect to the mantlet around the second axis G2.

According to another characteristic, the joint is of the mechanical or flexible type.

According to another characteristic, the mechanical joint is constituted firstly by a first trunnion integral with the weapon's cradle and with two bearings integral with an intermediate frame between the mantlet and the cradle of the weapon and secondly, by a second trunnion integral with the intermediate ring and with two bearings integral with the mantlet.

According to another characteristic, the flexible joint is constituted by plates of elastomer placed in a spherically shaped gap centred on the weapon's centre of gravity and made by parts fastened respectively on the weapon's cradle and on the mantlet.

According to another characteristic, the control means are formed by a motor meshed along the second axis of rotation G2.

According to another characteristic, the control means comprise a jack whose body is integral with the mantlet and whose rod is connected to the weapon.

According to another characteristic, the control means comprise a jack whose body is integral with the weapon and whose rod is connected to the mantlet.

According to another characteristic, the second positioning means in elevation and the second lateral angular positioning means of the weapon are combined so as to form a cardan joint.

According to another characteristic, the weapon is articulated in elevation with respect to a frame itself articulated laterally with respect to the mantlet.

According to another characteristic, the control means for the secondary joints are constituted by jacks or geared motors respectively placed between the mantlet and the intermediate frame on the one hand, and on the other, between the intermediate frame and the weapon's cradle.

A first advantage of the system according to the invention lies in the satisfaction of the organisational requirements of the weapon system by displacing the axis of articulation so as to satisfy the constraints of functional or overall optimisation.

Another advantage lies in the satisfaction of the absolute orientation quality requirements to be imposed on the weapon by adopting a second joint at the centre of gravity.

Another advantage lies in the reduction of parasite torques between the weapon and the mantlet.

Yet another advantage lies in the creation of a compact and simple joint in the form of a cardan so as to ensure the secondary and elevation rotation of the weapon.

Another advantage lies in the introduction of a lateral degree of freedom perpendicular to the firing axis of the weapon that allows the weapon to be maintained in its lateral orientation in the aiming direction with having to displace the whole turret accurately.

BRIEF DESCRIPTION OF THE DRAWINGS

Other characteristics, particulars and advantages of the invention will become more apparent from the description hereafter given by way of illustration and in reference to the drawings, in which.

DETAILED DESCRIPTION OF EMBODIMENTS

It goes without saying that the weapon is mounted using a large diameter bearing onto a mobile carrier classically in traverse on a vehicle. The weapon thus passively follows the rotation of this support. In the following description, this rotation in traverse although always taken into account is not described in any further detail. Consequent to the above, the invention consists in providing three other motorizations for the weapon with respect to a support that is mobile in rotation and on which it is mounted. A first motorization, or main motorization, allows the weapon to be roughly oriented in elevation at an angle generally between −10° and 60°. This motorization allows the weapon to be positioned without any constraints. A second motorization allows the weapon to be accurately oriented in elevation, by an angle of 0.5° approximately, bearing on the main elevation motorization. A third motorization consists in orienting the weapon accurately in traverse by an angle of between 0.5 to 2°, that is to say laterally and angularly, bearing indirectly in the turret via the two parallel elevation joint axes. The advantage of such a system according to the invention lies in the fact that the range between the weapon and the mantlet is limited to stabilisation errors, thereby making it easy to produce. Furthermore, since the dimensioning of the second and third motorizations is only linked to the inertia of the weapon to be oriented, an efficient torque control may be made without any specific constraints.

Figure 1:
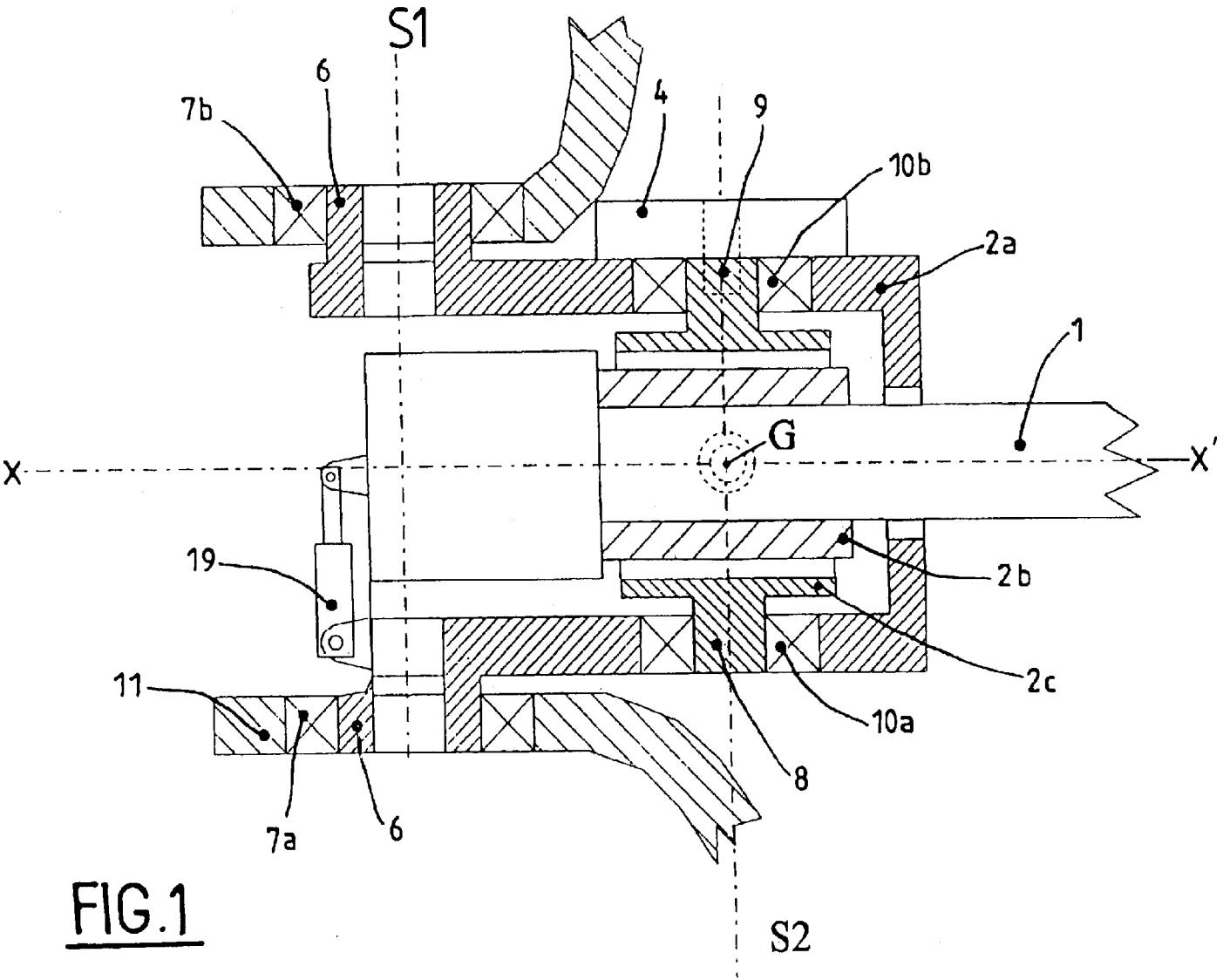
FIG. 1 is a top section view of the weapon through the weapon's axis.

FIG. 1 shows the weapon 1 to be oriented in elevation in relation to the mantlet 2*a* itself mounted able to rotate with respect to a support 5 (FIG. 2), for example a turret, by means of main trunnions 6 and two bearings 7*a* and 7*b* along axis S1. In the Figure, we can see that the mantlet 2*a* is in the form of a cage into which the rear part of the weapon is engaged. The weapon is itself mounted able to slide with respect to a cradle 2*b*, in a known manner. According to the invention, the cradle 2*b* is connected to the mantlet 2*a* by means of an intermediate ring 2*c* defining a joint around which the weapon 1 is able to rotate laterally. This ring, of the cardan type for example, is connected to the mantlet 2*a* by means of trunnions 8 and by bearings 10*a*, 10*b*. An actuator 4 integral with the mantlet 2*a* drives the weapon in rotation in elevation by means of a shaft 9 integral with the trunnions 8. In the example shown, the actuator 4 is a motor or geared motor integral with the mantlet.

Figure 2:
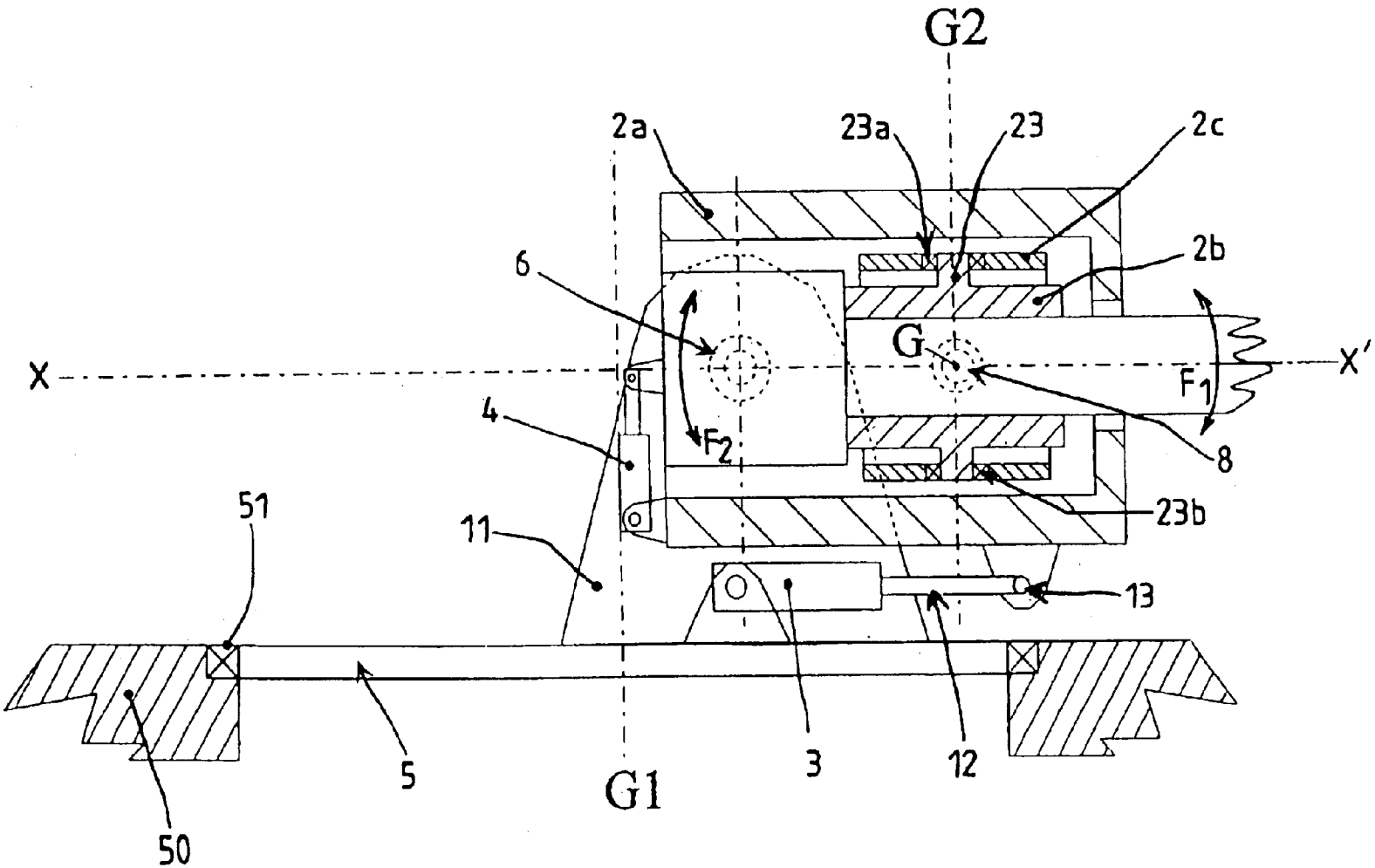
FIG. 2 is a side section view of the weapon through the lateral traverse rotation axes.

FIG. 2 shows the weapon 1 mounted onto a support 5 by means of a frame 11. Classically, the support is a turret mounted on a carrier 50 by means of a large diameter bearing 51. The mantlet 2*a* and trunnions 6, around which the weapon rotates in elevation with respect to the frame 11, have been illustrated schematically. The mantlet 2*a* is made to rotate by rotation means 3 constituted by a jack whose rod 12 is integral with the mantlet 2*a* via a spindle 13 and the body of the frame 11. By activating the jack 3, the mantlet 2*a* and thus also the weapon 1 are made to rotate around the trunnions 6 to roughly orient the weapon by a substantial amplitude with respect to the frame 11. This amplitude may cover a range of around −10 to +60° in the direction of the arrow F1. The weapon 1 is itself mounted able to rotate with respect to the mantlet 2*a* by a low amplitude so as to ensure its accurate orientation in elevation. This rotation has been schematised as arrow F2. This rotation is carried out using a jack 4 whose body is integral with the mantlet 2*a* and the rod with the weapon 1 and more precisely with the cradle. This jack 4 imparts a movement to the weapon around its secondary trunnions 8 and with respect to its carrying structure, that is to say the mantlet 2*a*. This amplitude may cover a range of around 1°.

The trunnions 6 and bearings 7 define the main elevation axis S1 around which the motorization is made along a wide elevation range, for example from −10 to 60°, and the rotation of the mantlet 2*a* and thus of the weapon, with respect to the support.

The trunnions 8 and the bearings 10*a*, 10*b* define the secondary elevation axis S2 around which the motorization is made along a small range, 0.5° for example, and the rotation of the weapon with respect to the mantlet 2*a*. It may be arranged for these secondary trunnions to be located at the weapon's centre of gravity without this limiting the scope of the invention. This centre of gravity G is substantially at the point of intersection of axis XX' of the weapon and axis S2.

FIG. 2 shows in greater detail the lateral secondary axis of rotation G2 of the weapon in relation to the mantlet 2*a*, via intermediate ring 2*c*. This rotation is obtained by means of a double trunnion, fastened to the cradle and able to move with respect to the ring 2*c* via bearings as will be explained hereafter with reference to FIG. 4.

Motorization means 19 (shown in FIG. 1) allow the weapon to be accurately oriented laterally and angularly bearing on the cradle of the weapon 1 and the mantlet 2*a* or between the cradle 2*b* and the intermediate ring 2*c*. Note that the secondary elevation motorization connected to the weapon by means allowing it to recoil may also be applied directly between the mantlet 2*a* and the intermediate ring 2*c*, the advantage of this solution being to naturally minimise the couplings that may appear between a secondary motorization and the orthogonal secondary axis.

Thus, the laying system according to the invention allows:

- a first orientation to permit the weapon to move in elevation with respect to the frame in the direction of arrow F1 and to satisfy the general functional and geometric constraints. A classical sealing system is, of course, provided between the mantlet and the turret (not shown),
- a second orientation centred on the centre of gravity G of the weapon to permit a limited elevation range in the direction of arrow F2,
- a third orientation centred on the centre of gravity G to permit a limited angular lateral range as will be explained hereafter.

It goes without saying that the system according to the invention is integrated into a complex assembly allowing the weapon to be oriented according to the firing co-ordinates, its position and any deviation from its instructions to be determined, any variations in laying when the vehicle is in motion to be measured and any deviations measured to be corrected.

Given that the second joint is integral with the mobile mantlet under the action of the first means it-is thus this first motorization and the servo-control of axis S1 that will absorb both the disturbances caused by the friction on the seals and the vertical linear accelerations.

The sealing to be installed at the bellows (between the weapon and the mantlet) mounted on this type of weapon is thus of relatively small dimensions and the limited range does not require a friction system to be installed but simply an elastic bellows type system. The bearings of this joint are also limited in dimension in that they do not have to integrate heavy functional constraints (replenishing of the weapon, for example). Moreover, since the joint is centred, the acceleration disturbances have no effect on the orientation of the weapon.

The elevation range of the weapon 1 with respect to the mantlet 2*a* is subjected to two constraints:

the range must enable the stabilisation errors of the first axis S1 to be absorbed, the range must be limited by the decentring between the weapon's axis and the main trunnions 6. Indeed, the recoil stress of the weapon is translated firstly by a perturbing torque that must be withstood by the main motorization and secondly, by the radial acceleration induced by the mantlet on the centre of gravity of the weapon with its effect of the firing in progress and/or on the following firings (for a weapon that fires in bursts).

As can be seen in FIG. 2 an actuator 4 has been provided to ensure the small amplitude movements of the weapon with respect to the mantlet 2*a*. This actuator may in fact be an electric geared motor whose resistance is low enough and whose servo-control under strain is of sufficient pass band. It is also possible to provide a hydraulic motorization constituted by a low range hydraulic jack. To impose a minimum elasticity on the oil, the dead volume of each of the two chambers of the jack may be artificially increased by small drained accumulators. As indicated in the aforementioned French patent, motorization with servo-controlled pressure is used to servo-control the absolute velocity of the weapon, such velocity being obtained directly by a gyrometer or using a gyroscope mounted on the mantlet 2*a*, with derivation of the sum of the gyroscopic deviation and the relative position between the mantlet 2*a* and the weapon 1.

Figure 3:
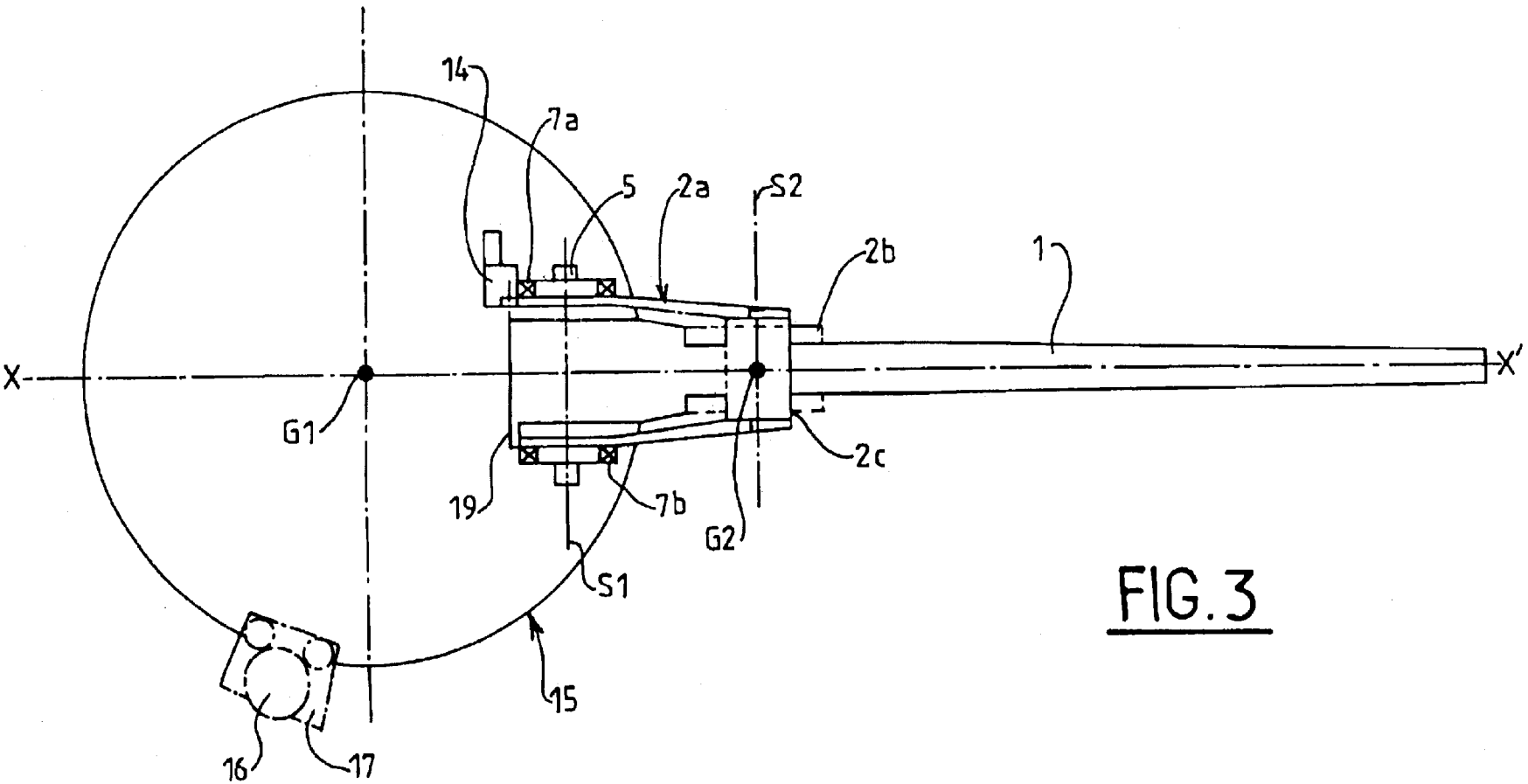
FIG. 3 is an overall view of a weapon and its mounting mantlet on the frame.

FIG. 3 shows a top view of a weapon 1 in the form of a section made along its longitudinal axis XX'. In this Figure, we have shown the path 15 of travel of the frame 5 or turret 50 and we see that axis G2 is located outside of the path 15. In this type of weapon, the centre of gravity is substantially offset with respect to the axis of rotation in elevation S1. This turret is able to rotate in traverse around axis G1 covering an angle of 360°. The turret thus drives the weapon 1 to orient it roughly in traverse. To this end, a motor 16 drives the turret 50 by means of reducing gear 17. The weapon 1 is mounted on the frame 5 on an elevation axis S1 around which it is driven in rotation by the geared motor 14 and on a second elevation axis S2 at its centre of gravity.

According to one particularity of the invention explained previously, a traverse axis G2 is provided around which the weapon itself will be activated so as to accurately orient it laterally, axis G1 being the traverse axis of the turret as described previously. Note that axes G1 and G2 are perpendicular to the plane of the Figure. A lateral joint is thus provided between the weapon 1 and the mantlet 2*a*, and more specifically between the cradle 2*b* and the intermediate ring 2*c* and the rotation of the weapon 1 is ensured using control means in rotation 19. These means ensure the positioning of the weapon and may, for example, be a geared motor or a jack. The jack body may be integral with the mantlet and its rod connected to the weapon, or else the body of the jack is integral with the weapon and its rod with the mantlet.

Thanks to this arrangement and angular lateral rotation of the weapon of around 2° may be obtained with respect to its longitudinal axis. It is given that the orientation of the weapon maybe fully known whatever the roll position of the vehicle.

Figure 4:
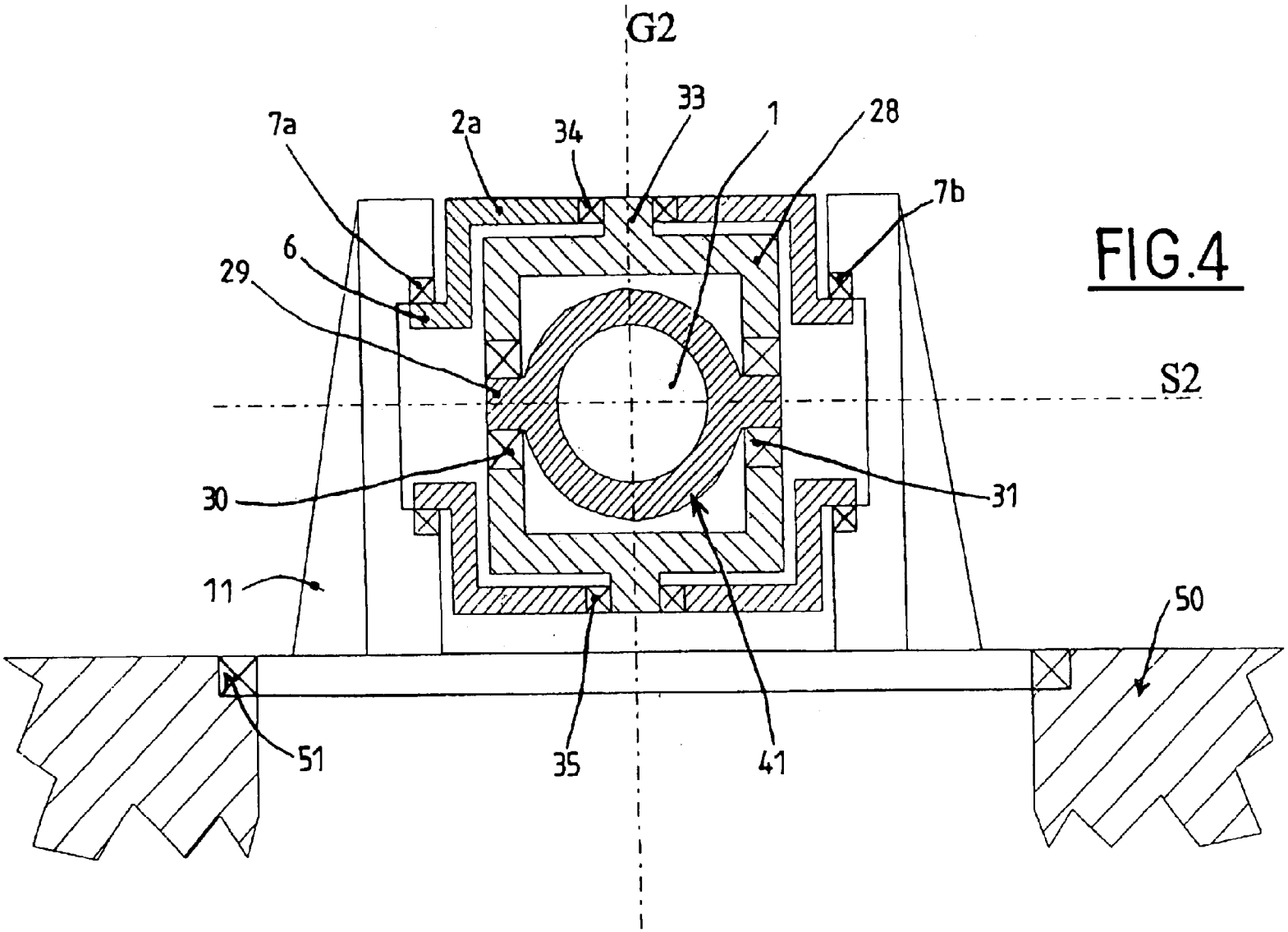
FIG. 4 is a section showing one example of a joint in the weapon, of the cardan type.

FIG. 4 shows a view along the axis of the weapon of a joint of the weapon 1 with respect to the mantlet 2*a* in which two rotations have been combined. This has the particularity of inverting G2 and S2. To this end, the weapon 1 is integral with a first frame 28 by means of a trunnion 29 and bearings 30 and 31. The frame, and thus the weapon, is able to rotate around axis S2. The frame 28 is then mounted integral with the mantlet by means of a trunnion 33 engaged in two bearings 34 and 35. The weapon is thus also able to rotate around axis G2. This assembly allows the weapon 1 to be articulated around axis G2 through the weapon's centre of gravity (it is the lateral angular rotation) and in elevation around axis S2. This structure thus allows two fine rotations of the weapon in elevation and in traverse to be combined in a compact assembly of the cardan type providing great flexibility. The frame 11 on which the weapon is mounted has also been illustrated. The frame 11 is integral with the carrier 50 by means of a large diameter bearing 51.

Figure 5:
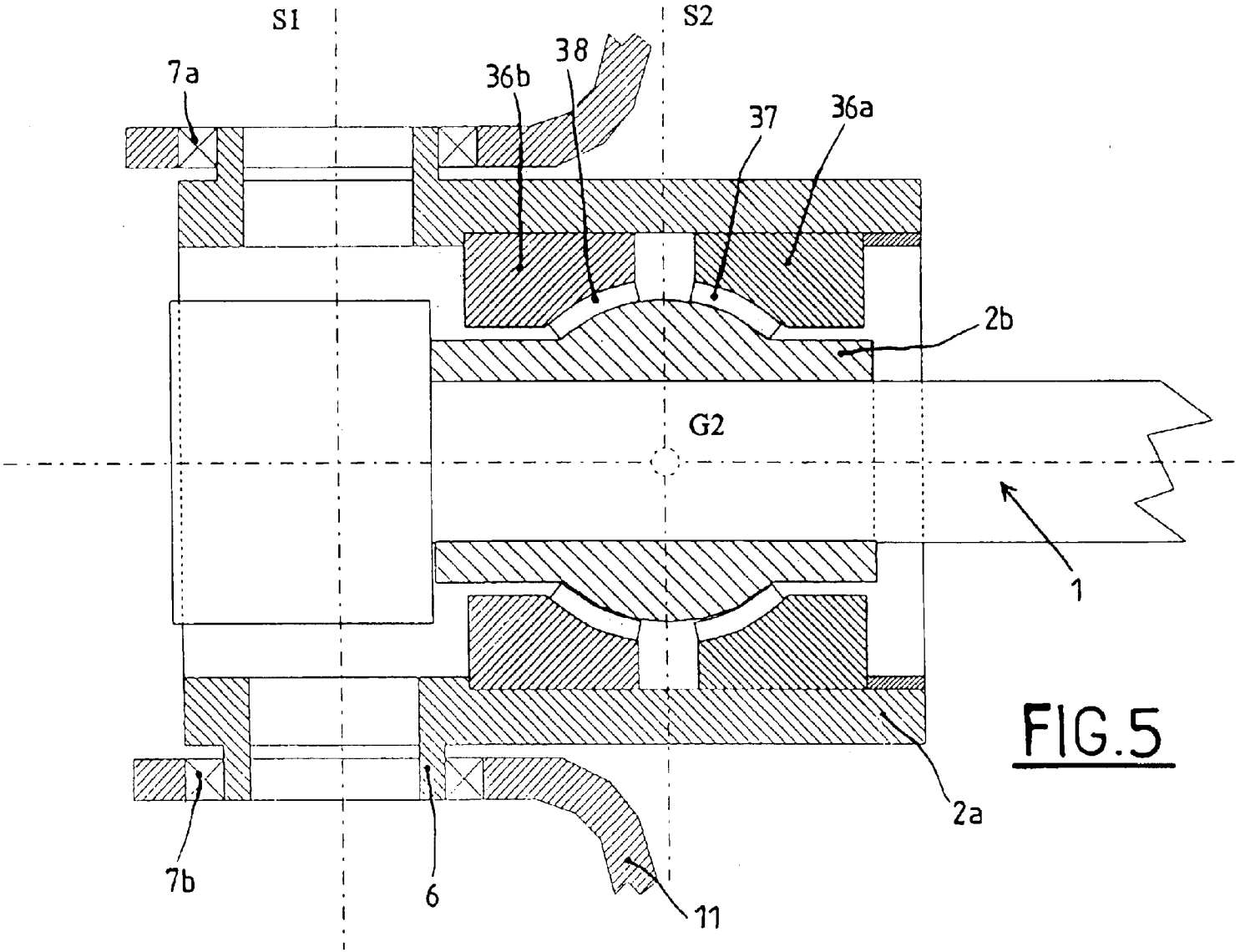
FIG. 5 is a top section view of the weapon showing another joint with flexible torque ball.

The joint may be of the flexible type. FIG. 5 shows an embodiment of a flexible joint. This is constituted by a spherically-shaped gap positioned between the cradle 2*b* and the mantlet 2*a* in which plates of elastomer 37 and 38 are inserted. The cradle has a spherical outgrowth separated from parts 36*a* and 36*b* forming the gap. In this type of joint, the elastomer plates are defined in shape and constitutive material firstly so as to provide great radial stiffness and great resistance to withstand the axial recoil stresses of the weapon, and secondly to be of a reduced stiffness in relation to the angular range of up to 2° in traverse and 10 in elevation. The stiffness associated with this degree of freedom corresponds approximately to a maximal load that must be limited between 10 and 20% of the maximal load of the associated secondary motorization. A lateral radial stiffness is also specified parallel to the trunnion axis of the mantlet that is enough to minimise its effect on the torquing dynamic of the secondary lateral motorization.

Thus, the weapon 1 is mobile both in the plane of the Figure in lateral angular rotation and in a perpendicular plane in elevation.

To position the weapon, an inertial absolute position sensor constituted by a gyroscope is used that serves as a reference both for the line of sight, for the weapon and the mantlet. The gyroscopic sensor is preferentially mounted on the mantlet and may be replaced by a two axes gyrometer that measures the lateral angular velocities of the mantlet and in elevation, such velocities being integrated to materialise the gyroscopic reference position. The absolute position of the cradle is computed using a linear position measurement made in the vicinity of each of the secondary actuators enabling a torque to be exerted on the weapon.

Generally speaking, any secondary motorization able to apply a torque to the cradle and the weapon in a sufficient pass band may be used.

To implement the system according to the invention a set of sensors is used:

at least one angular sensor of the mantlet 2*a* in relation to the orientation of the turret. By derivation, the relative velocity of the mantlet and of the turret is obtained, at least one relative angular position sensor between the cradle and the mantlet around each of the secondary axes S2 and G2, at least one gyroscopic type sensor to supply the inertial reference allowing, for example, the line of sight to be materialised and from which the absolute angular position of the weapon can be determined. A derivation of the relative data will allow the absolute velocity of the mantlet to be obtained by adding it to the precession control of the gyroscope, at least one radial acceleration sensor on the mantlet, at right angles to the main axis of rotation G1 allowing a measurement of the linear acceleration disturbance to be obtained.

These sensors as a whole allow us to know part of the knowledge of the reference onto which the weapon is to be oriented and secondly data concerning the main disturbances acting on the weapon system. Secondary sensors correspond respectively to the angular rotational velocity of the electric motor of the main motorization and to the differential pressure between the chambers of the secondary jack, the latter data corresponding directly to the torque applied by the secondary motorization to the weapon.

What is claimed is:

1. An elevation and traverse laying system for a weapon having first traverse positioning means to position the weapon in traverse along a large angular range with respect to a first traverse axis of rotation, the elevation and traverse laying system comprising:

first positioning means in elevation for elevating the weapon over a large range with respect to a first axis of rotation in elevation, the first axis of rotation in elevation offset with respect to a centre of gravity of the weapon;

second positioning means in elevation for elevating the weapon over a small range with respect to a second axis of rotation in elevation; and second traverse positioning means to position the weapon in traverse with respect to a second traverse axis of rotation allowing a small lateral range for the weapon, the second axis of rotation in elevation and the second traverse axis of rotation passing substantially through the centre of gravity of the weapon.

2. The laying system according to claim 1, wherein the first axis of rotation in elevation is located to the rear of the centre of gravity of the weapon.

3. The laying system according to claim 1, wherein the first positioning means in elevation ensures the articulation of the weapon with respect to a frame onto which the weapon is mounted around the first axis of rotation in elevation.

4. The laying system according to claim 3, wherein the first positioning means in elevation comprises a mantlet supporting the weapon and a first means accomplishing the large angular range integrated with the frame, the first axis of rotation in elevation being between the mantlet and the frame.

5. The laying system according to claim 4, wherein the first rotation means ensures the rotation of the mantlet with respect to the frame.

6. The laying system according to claim 5, wherein the first rotation means is formed by a jack or geared motor.

7. The laying system according to claim 4, wherein the weapon is mounted able to rotate with respect to the mantlet, the second positioning means in elevation ensuring the articulation in elevation of the weapon by rotating the weapon with respect to the mantlet around the second axis of rotation in elevation.

8. The laying system according to claim 1, wherein the second positioning means in elevation comprises an intermediate ring connected to the weapon and second rotation means for rotating the weapon in the small range about the second axis of rotation in elevation around trunnions mounted to said ring.

9. The laying system according to claim 8, further comprising a mantlet, wherein the second rotation means is formed by a motor or geared motor integral with the mantlet.

10. The laying system according to claim 8, further comprising a mantlet, wherein the second rotation means may comprise a jack integral with the mantlet and whose rod is connected to the weapon or to a cradle integral with the weapon, such cradle with respect to which the weapon recoils upon firing.

11. The traverse laying system for a weapon according to claim 10, wherein the second traverse positioning means of the weapon is integral with the cradle to ensure a low lateral angular range of the weapon around the second traverse axis of rotation passing through the weapon's centre of gravity.

12. The laying system according to claim 11, wherein the lateral angular range of the weapon with respect to the mantlet is of around 2°.

13. The laying system according to claim 12, wherein the control means comprise a jack whose body is integral with the weapon and whose rod is connected to the mantlet.

14. The laying system according to claim 12, further comprising a mantlet, wherein the control means for the secondary position means in elevation and the second traverse positioning means are constituted by jacks or geared motors respectively placed between the mantlet and the second traverse positioning means on the one hand, and on the other, between the second traverse positioning means and the secondary positioning means in elevation.

15. The laying system according to claim 11, wherein the second traverse positioning means comprises an intermediate frame or ring supporting the weapon and connected to the mantlet and means to control the lateral rotation of the weapon with respect to the mantlet.

16. The laying system according to claim 15, wherein the control means are formed by a motor associated with the second traverse axis of rotation.

17. The laying system according to claim 15, wherein the weapon is mounted by means of a joint with respect to the mantlet, the control means ensuring the rotation of the weapon with respect to the mantlet around the second traverse axis of rotation.

18. The laying system according to claim 17, wherein the control means comprise a jack whose body is integral with the mantlet and whose rod is connected to the weapon.

19. The laying system according to claim 17, wherein the joint is of a mechanical or flexible type.

20. The laying system according to claim 19, wherein the mechanical type joint is constituted firstly by a first trunnion integral with the cradle and with two bearings integral with an intermediate frame between the mantlet and the cradle of the weapon and secondly, by a second trunnion integral with the intermediate ring and with two bearings integral with the mantlet.

21. The laying system according to claim 19, wherein the flexible type joint is constituted by plates of elastomer placed in a spherically shaped gap centred on the centre of gravity and made by parts fastened respectively on the cradle and on the mantlet.

22. The laying system according to claim 1, further comprising a mantlet, wherein a mounting of the second positioning means in elevation and the second positioning means in traverse of the weapon are inverted with respect to the mantlet.

23. The laying system according to claim 22, wherein the weapon is articulated in elevation with respect to a frame itself articulated in traverse with respect to the mantlet.

* * * * *